US006144314A

United States Patent [19]

Yasue

[11] Patent Number: 6,144,314

[45] Date of Patent: Nov. 7, 2000

[54] SELECTIVE CALL RECEIVER WITH MOTION DETECTOR

[75] Inventor: Tadashi Yasue, Shizuoka, Japan

[73] Assignee: NEC Corporation, Tokyo, Japan

[21] Appl. No.: 08/989,296

[22] Filed: Dec. 11, 1997

[30] Foreign Application Priority Data

Dec. 20, 1996 [JP] Japan ..... 8-340702

[51] Int. Cl.[7] ..... G08B 5/22

[52] U.S. Cl. ..... 340/825.44; 455/426; 455/38.4; 455/38.1; 370/313; 326/8

[58] Field of Search ..... 340/825.44, 825.69, 340/566, 669, 692; 455/426, 38.4, 140, 526, 517, 575, 31.1, 31.2, 38.2, 410, 412; 370/312; 326/8

[56] References Cited

U.S. PATENT DOCUMENTS

| | | | |
|---|---|---|---|
| 5,027,105 | 6/1991 | Dailey et al. | 340/566 X |
| 5,153,566 | 10/1992 | Yun | 340/566 X |
| 5,493,284 | 2/1996 | Kondo | 340/825.44 |
| 5,523,742 | 6/1996 | Simkins et al. | 340/566 X |
| 5,535,427 | 7/1996 | Miyashita et al. | 455/38.2 |
| 5,610,590 | 3/1997 | Johnson et al. | 340/566 X |
| 5,646,589 | 7/1997 | Murray et al. | 340/825.44 |
| 5,726,643 | 3/1998 | Tani | 340/825.44 X |
| 5,847,647 | 12/1998 | Devine | 340/566 X |

FOREIGN PATENT DOCUMENTS

| | | |
|---|---|---|
| 4-268854 | 9/1992 | Japan . |
| 7-170550 | 7/1995 | Japan . |
| 8-75497 | 3/1996 | Japan . |

*Primary Examiner*—Michael Horabik
*Assistant Examiner*—Anthony A. Asongwed
*Attorney, Agent, or Firm*—Ostrolenk, Faber, Gerb & Soffen, LLP

[57] ABSTRACT

A wireless selective-call receiver makes use of detection or absence of any to-and-fro movement of the receiver indicating that the receiver has been left somewhere thereby improving the security function of the receiver. When a motion detector detects no continuous shaky movement of the receiver, the message received by the receiver is stored in memory. A controller comprises a first control section which operates in a no movement condition, a second control section which operates in a moving condition, and a switching means for switching from the first control section to the second control section and vice versa. In the absence of the to-and-fro movement of the receiver (for example, the receiver is put away from the owner's body to be left on the desk), any access through a button inputting console and external interface except inputting a password is rejected. The message received is stored in memory, and not given on display, thereby preventing pieces of private information from leaking. In the absence of the shaky movement of the receiver the sound-making section alarms a sound at regular intervals, and an emergency contact address or telephone number is exhibited on display. Thus, the receiver once lost can be returned to the owner easily while maintaining security of information stored in the memory.

28 Claims, 4 Drawing Sheets

SELECTIVE CALL RECEIVER WITH MOTION DETECTOR

BACKGROUND OF THE INVENTION

1. Field of the Invention

The present invention relates to a wireless selective-call receiver and particularly, to a wireless selective-call receiver equipped with a continuous shaky movement detector for detecting any regular or irregular to-and-fro movement of the receiver's body, thereby providing a security function in response to the absence of continuous shaky movement of the receiver's body.

2. Description of the Prior Art

Wireless selective-call receivers are known as pagers.

There are many examples of applications for a wireless selective-call receiver which uses a detected to-and-fro movement of the body of the wireless selective-call receiver. For instance, Japanese Patent Application Laid-Open No. 4-268854 discloses a calling device for portable telephones, which device permits "vibration" to be selected to inform a person of a telephone call when the to-and-fro movement of the body of the portable telephone is detected as the so detected shaky movement indicates that the person has the portable telephone with him. The calling device permits "light" to inform the person of a telephone call when the to-and-fro movement of the body of the portable telephone is not detected, as the person is supposed to leave the telephone somewhere. The manner in which the person is informed of a telephone call can be automatically selected so as to be appropriate for the situation.

Japanese Patent Application Laid-Open No. 7-170550 shows a paging receiver which uses a signal representing the to-and-fro movement of the receiver's body both for counting the number of steps taken by the person while walking and for driving associated means for preventing the person from being informed of a telephone call. Thus, the paging receiver can be used as a step counter, and if the paging receiver is shocked with a force stronger than a predetermined strength, or if it is dropped inadvertently, it will be put in anti-information condition.

Japanese Patent Application Laid-Open No. 8-075497 shows a walking-data-producing device which can produce desired data to the walker in real time.

These conventional wireless selective-call receivers are equipped with means for making an automatic selection between different modes of informing the person of a telephone call depending on whether the to-and-fro movement of the device's body is detected or not, means for displaying the number of steps taken by the walker, or means for putting the telephone in anti-information condition when shocked.

If, however, such a conventional wireless selective-call receiver is lost, it is unavoidable that the contents of private information stored in the receiver leak to others. Consequently the following problems may be caused:

First, assuming that the wireless selective-call receiver which works in the silent-call mode is left somewhere, the owner of the receiver can not easily find the receiver in a short time as he cannot hear the calling sound even if the receiver is in receiving operation.

Secondly, assuming that the wireless selective-call receiver is lost outdoors, there is a fear that information such as important messages, a telephone directory, ready-made sentences prepared by the owner of the receiver, guidances, alarm messages, schedule messages and so forth may be leaked to others.

Assuming that a telecommunication serving company employs a specific accounting system in which a subscriber shall pay for the amount of telephone calls received beyond certain hundreds per month, and that the wireless selective-call receiver is lost outdoors, permitting others to use the receiver, there is a fear that the subscriber is obliged to pay for the amount of undesired telephone receptions.

SUMMARY OF THE INVENTION

One object of the present invention is to provide a wireless selective-call receiver which is capable of providing an improved security function against such troubles as described above.

According to the present invention, there is provided a wireless selective-call receiver which comprises a receiving section for receiving a wireless selective call signal and message information; a display for displaying pieces of private information including the message information received by the receiving section; a memory for storing the contents of the private information; an exterior interface for permitting the wireless selective-call receiver to be connected to exterior devices; a button-inputting console for inputting commands and data; controlling means for controlling the display, the memory and the exterior interface in response to data from the receiving section, the memory, the exterior interface and the button-inputting console; and a detector for detecting any regular or irregular to-and-fro movement of the wireless selective-call receiver's body for outputting a signal representing the detected continuous shaky movement to the control, wherein the controlling means comprises a first control section for performing normal operation, a second control section for performing security operation, and a switching section for selectively switching from the first control section to the second control section or vice versa.

The pieces of private information may include at least one of messages, a telephone directory, ready-made sentences for daily use, guidances, alarm messages, schedules and memoranda.

In case that the wireless selective call signal received by the receiving section corresponds with the one allotted to the wireless selective-call receiver, the second control section may permit the contents of the message information received by the receiving section to be stored in the memory, and inhibits the contents from being displayed on the display.

The second control section inhibits the access to the pieces of private information stored in the memory required through the button-inputting console or the interface.

The second control section retrieves emergency telephone numbers from the memory for showing these emergency telephone numbers on the display.

The switching section is responsive to the instructions given through the button-inputting console at the time of power-on for selectively putting the first or second control section in operation.

When the second control section is selected for operation, and when the pieces of information given through the button-inputting console are in agreement with the password stored in the memory, the switching section is responsive to such agreement for switching from the second control section to the first control section.

When the second control section is selected for operation, and when the password given by the interface is in agreement with the password stored in the memory, the switching section may be responsive to such agreement for switching from the second control section to the first control section.

When the first control section is selected for operation, and when the to-and-fro movement of the wireless selective-call receiver's body is changed, and if it is decided that there is no movement, the switching section may switch from the first control section to the second control section.

The detector may comprise a contact detecting section which detects the to-and-fro movement of the wireless selective-call receiver's body by different contact conditions and a contact checking section for making a decision as to whether the wireless selective-call receiver's body moves to and fro or not.

The contact checking section may comprise a spherical cavity having contacts inside, and an electrically conductive spherical body movably contained in the cavity, thereby making a decision as to whether the wireless selective-call receiver's body moves to and fro or not by checking whether the electrically conductive spherical body continues to touch selected contacts one after another.

The contact detecting section comprises a spherical cavity having contacts inside, and an electrically conductive spherical body movably contained in the cavity, thereby detecting the to and fro movement of the wireless selective-call receiver's body by checking whether the electrically conductive spherical body continues to touch selected contacts one after another.

The contact detecting section keeps the same contacts when no vibration is applied and switches the contacts when vibration is applied.

The contact checking section makes a decision that the wireless selective-call receiver's body keeps still if the same contacts are kept for a predetermined period.

The contact checking section may have a cubic external shape.

The switching section has a function for setting a time zone in which the determined result of the detector is effective.

The controlling means has a function for enabling or disabling the operation of the detector.

The wireless selective-call receiver may further comprise a sound-making section responsive to instructions given by the control for making an alarm sound.

The second control section issue these instructions.

The second control section has a function for putting the sound-making section in operative or inoperative condition in which the alarm sound is permitted or prevented, respectively.

BRIEF DESCRIPTION OF THE DRAWINGS

Other objects and advantages of the present invention will be understood from the following description of the wireless selective-call receiver according to a preferred embodiment of the present invention, which is shown in accompanying drawings.

DETAILED DESCRIPTION OF THE PREFERRED EMBODIMENTS

Figure 1:
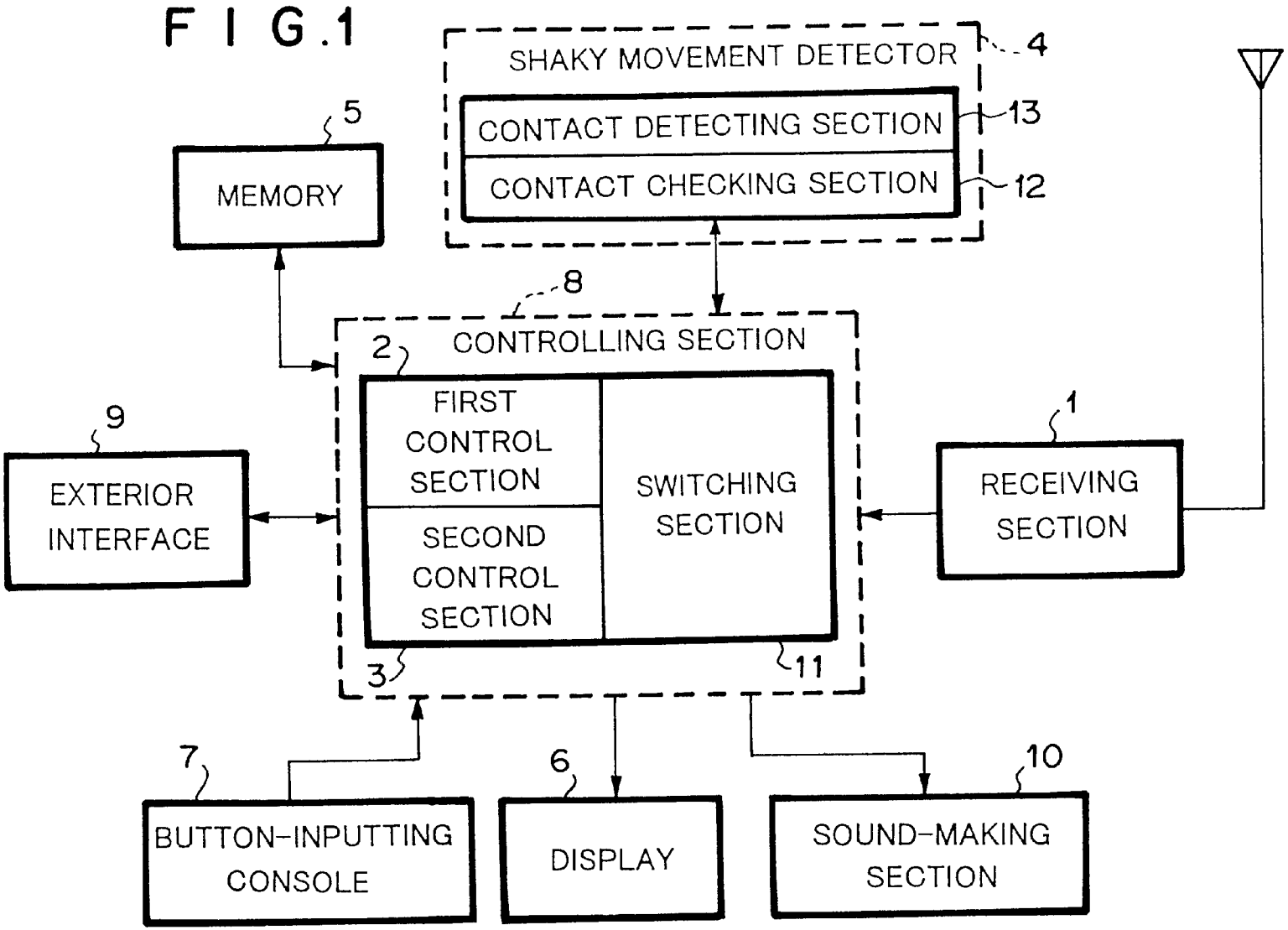
FIG. 1 is a block diagram of a wireless selective-call receiver according to the present invention.
Figure 2:
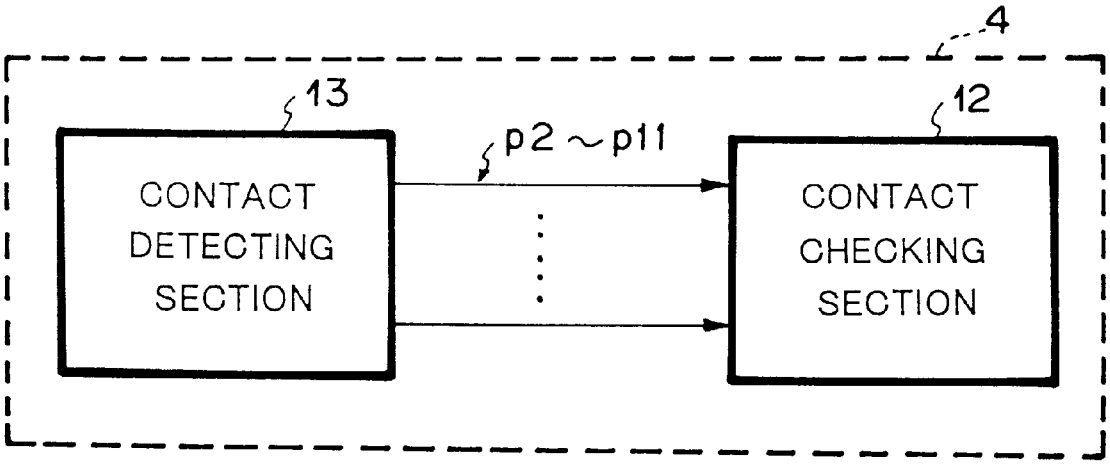
FIG. 2 is a block diagram of the shaky movement detector for detecting the to-and-fro movement of the receiver's body.

Referring to FIG.1, a wireless selective-call receiver according to the present invention comprises a receiver 1 for receiving a selective call signal and message information, display 6 for displaying pieces of private information including the message information received by receiver 1 memory 5 stores the contents of the private information. External interface 9 for permitting the wireless selective-call receiver to be connected to external devices (not shown). Button-inputting console 7 for inputs commands and data. Controlling section 8 is responsive to data from receiver 1, memory 5, exterior interface 9 and button-inputting console 7 and controls display 6, memory 5 and exterior interface 9. Detector 4 detects any regular or irregular to-and-fro movement of the receiver's body and outputs a signal representing the detected movement to controlling section 8. Sound-making section 10 is responsive to instructions given by the controlling section 8 and alarms at regular intervals when no to-and-fro movement of the receiver's body is detected.

The pieces of private information such as messages, a telephone directory, ready-made sentences for daily use, guidances, alarm messages, schedules or memoranda are stored in memory 5, and can be selectively retrieved from memory 5 to show selected pieces of private information on display 6. Controlling section 8 comprises first control section 2, second control section 3 and switching section 11 for switching from first control section 2 to second control section 3 or vice versa.

In case that detector 4 does not detect any to-and-fro movement of the receiver's body, switching section 11 switches from first control section 2 to second control section 3, and then the associated units work as follows: when the selective call signal received by receiver 1 corresponds to the one allotted to the wireless selective-call receiver, second control section 3 permits the contents of the message information received by receiver 1 to be stored in memory 5, but not given on display 6. Sound-making section 10 begins to activate alarm at regular intervals. Second control section 3 inhibits the access to the pieces of private information stored in memory 5 required through button-inputting console 7 or interface 9. When a password inputted through button-inputting console 7 is in agreement with the password stored in memory 5, switching section 11 switches from second control section 3 to first control section, thereby returning to the ordinary operation.

Referring to FIGS. 2 to 5, continuous shaky movement detector 4 comprises contact detecting section 13 which is responsive to the to-and-fro movement of the receiver's body and provides different contact conditions and contact checking section 12 for making a decision as to whether the receiver's body moves to and fro or not. Contact detecting section 13 comprises a spherical cavity g1 having contacts inside, and an electrically conductive spherical body g2 movably contained in the cavity g1. Reference marks p2 to p11 indicate the points at which electrically conductive spherical body g2 touches selected contacts in the spherical cavity g2, as later explained. As seen from FIG. 3, preferably contact detecting section 13 has a cubic shape.

Figure 3:
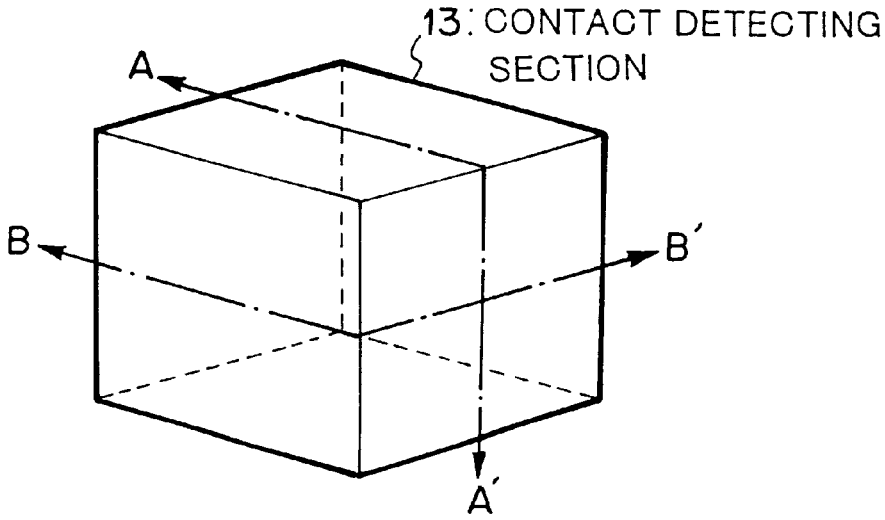
FIG. 3 is a trimetric projection view of the contact detecting section of the shaky movement detector.
Figure 4:
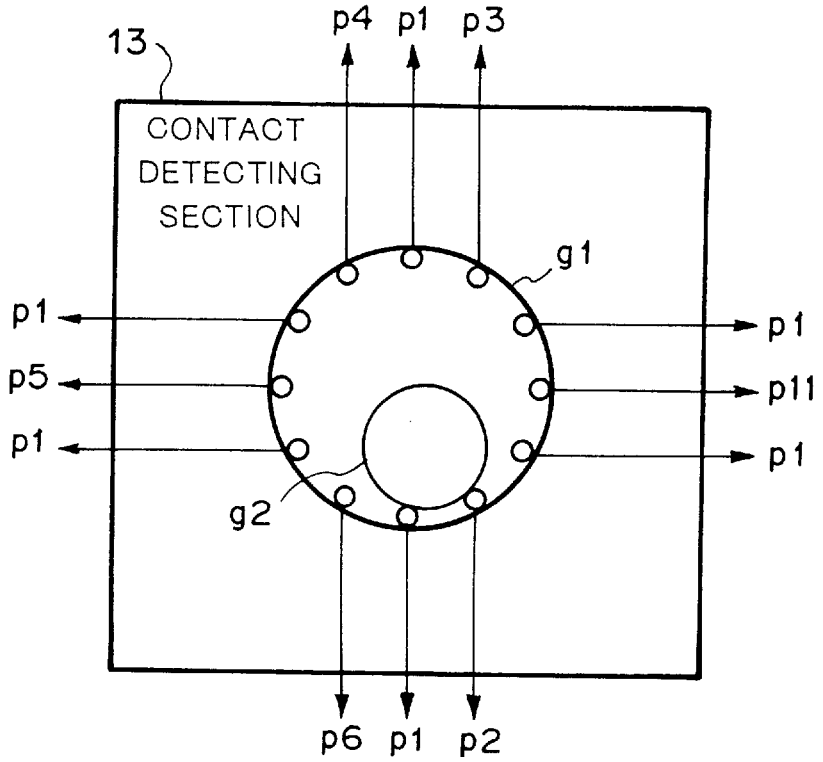
FIG. 4 is a longitudinal cross-sectional view of the contact detecting section.

FIG. 4 shows a longitudinal cross-sectional view of the contact detecting section 13 of which direction is taken by line A–A' as shown in FIG. 3 Referring to FIG. 4, contact detecting section 13 is made of an insulating material. Electrically conductive spherical body g2 is included inside larger spherical cavity g1. As shown, spherical cavity g1 has contacts p1 to p6 and p1 arranged on its inner wall, which contact the circumference of electrically conductive spherical body g2. Contacts p1s make up grounding points, and are preferably rings arranged concentrically in the horizontal and vertical directions, thereby forming a lattice. Each of the other contacts p2 to p6 and p11 are arranged between two adjacent grounding points p1, thereby permitting the electrically conductive spherical body g2 to touch the grounding point p1 and any of contacts p2 to p6 and p11 all the time. In FIG. 4 electrically conductive spherical body g2 touches grounding point p1 and contact p2. When the receiver moves to and fro, spherical body g2 moves to any of contacts P3 to P6 and P11. When the receiver is still, spherical body g2 stays on the same grounding point and a selected contact such as p2, remaining still there. A decision of no shaky movement is made if this contact condition lasts for a given time.

Figure 5:
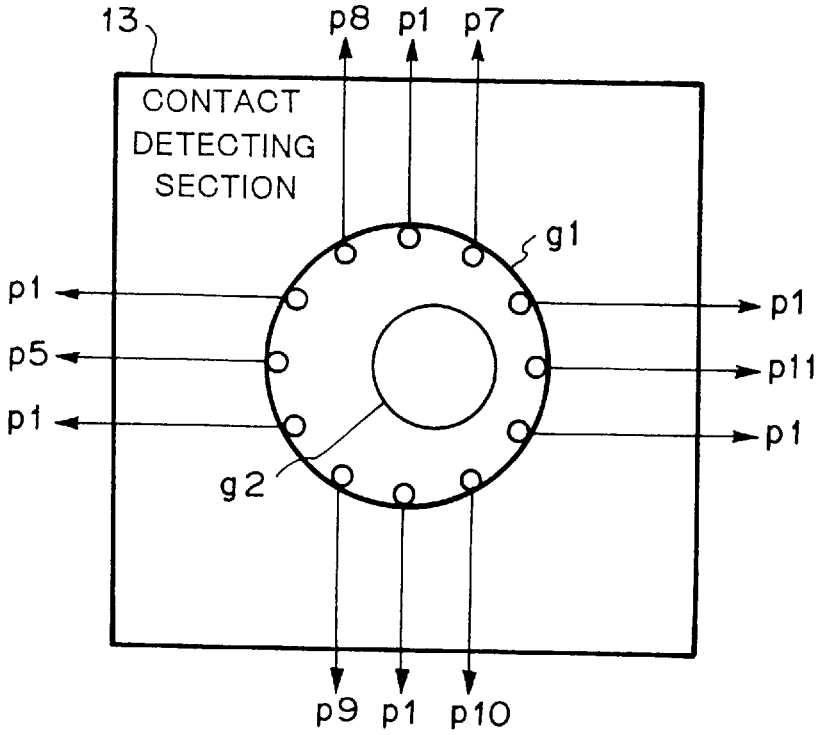
FIG. 5 is a horizontal cross-sectional view of the contact detecting section.

FIG. 5 shows a horizontal cross-sectional view of the contact detecting section 13 of which direction is taken by line B–B' as shown in FIG. 3. As similar to the view of FIG. 4, g1 represents a cavity and g2 represents an electrically conductive spherical body. Spherical cavity g1 has contacts p1, p2, p5, and p7 to p1 arranged on its inner wall.

Contact checking section 12 determines which of the contacts p2 to p11 that electrically conductive spherical body g2 touches. For instance, contact checking section 12 determines that electrically conductive spherical body g2 touches the contact p2, and then, contact checking section 12 makes a decision that the receiver's body is not moving to and fro if electrically conductive spherical body g2 continues to touch contact p2 and does not change the contact to any of the other contacts p3 to p11 for a predetermined period of time. Then, contact checking section 12 informs controlling section 8 that the receiver is keeping still. On the contrary, contact checking section 12 determines that the receiver's body is moving if spherical body g2 moves to any of contacts p3 to p11 and informs controlling section 8 that the receiver's body is moving.

Figure 6:
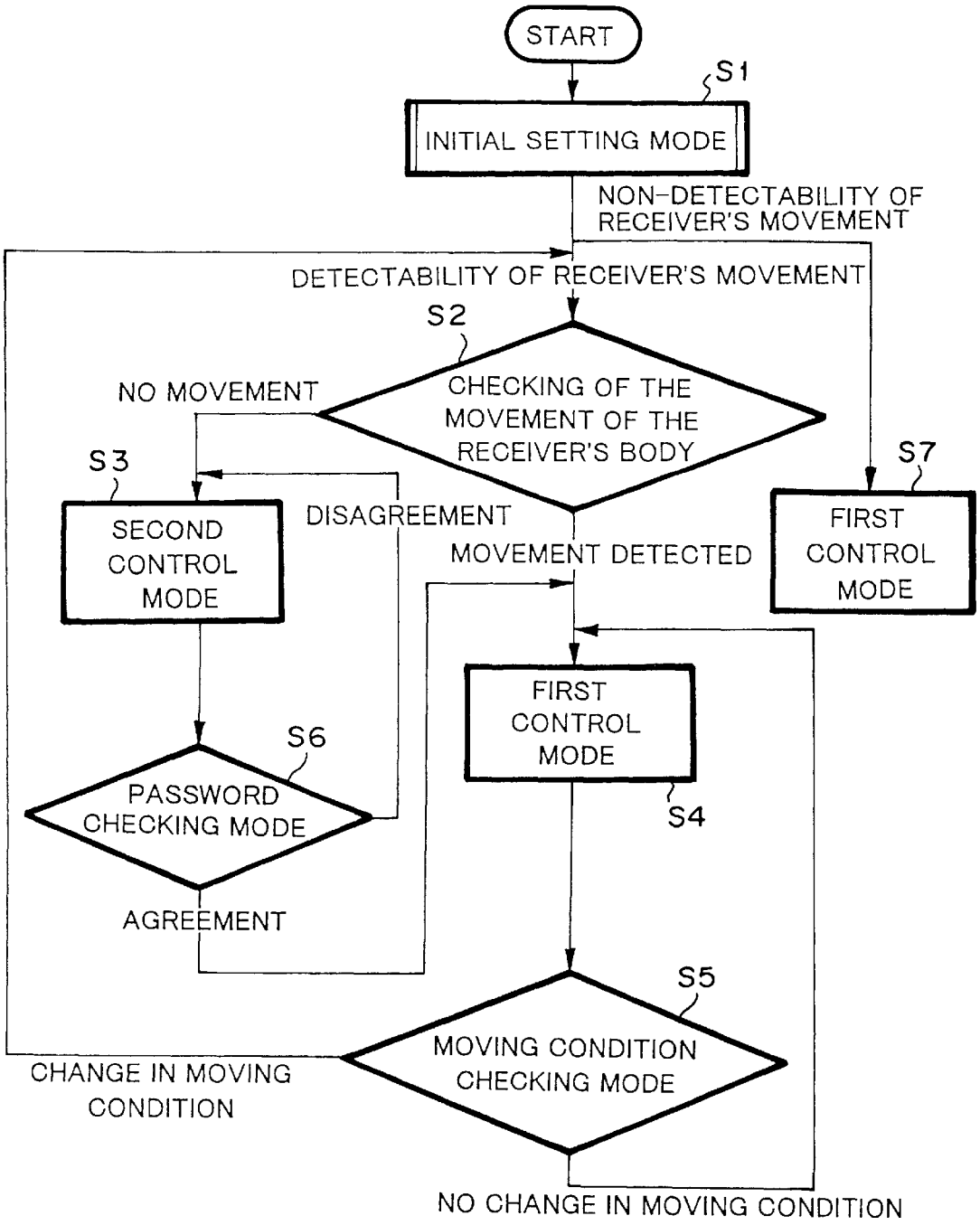
FIG. 6 is a flowchart showing how the controlling means operates.

Referring to FIG. 1 and FIG. 6, the wireless selective-call receiver works as follows:

first, the power switch turns on (START);

in the initial setting mode (S1) selection is made between detectability of receiver's movement and non-detectability of receiver's movement by the input through button-inputting console 7;

in case of non-detectability of receiver's movement being selected, switching section 11 selects first control section 2 for the ordinary operation (S7).

If detectability of the receiver's movement being selected, the following procedures start:

switching section 11 conducts the checking of the to-and-fro movement of the receiver's body on the basis of the information from shaky movement detector 4 (S2);

in case of decision of no movement detected, switching section 11 selects second control section 3 which:

(a) stores messages received from the receiver 1 in memory 5 while not displaying the messages on display 5;

(b) rejects the request from button inputting console 7 of reading private information such as messages already received, telephone directory, ready-made sentences, guidances, alarm messages, memoranda and so forth;

(c) rejects the request from button inputting console 7 of registering private information such as telephone directory, ready-made sentences, guidances, alarm messages, memoranda and so forth;

(d) rejects the request from external interface 9 of access to information such as telephone directory, ready-made sentences, guidances, alarm messages, memoranda and so forth and of reading messages already received; and (e) submits sound-making section 10 to sound a special alarm, reading the emergency contact telephone number from memory 5 and making display 5 display the emergency contact telephone number periodically.

In the password checking mode (S6), switching section 11 conducts the checking of the truth or falsehood of the password given through button-inputting console 7 or exterior interface 9. An option of rejecting the checking of the truth or falsehood of the password given via exterior interface 9 is available for the fear of allowing others to determine what the password is by connecting a personal computer to exterior interface 9 for decipherment.

In case that the password corresponds with the one stored in memory 5 at password checking mode (S6), switching section 11 of the control 8 switches from second control section 3 to the first control section 2, thus permitting the receiver to return to the ordinary mode of operation.

In the moving condition checking mode (S5), switching section 11 is responsive to a signal from shaky movement detector 4 representing the transition from movement to non-movement or vice versa for returning to the receiver's movement detecting mode (S2).

The wireless selective-call receiver is capable of: setting a time zone for which the receiver's movement detection is effective; selectively setting the receiver to be detectable or undetectable of receiver's movement; and selectively setting the receiver to alarm a special sound in security mode or not to alarm.

As may be understood from the above, if an owner leaves his receiver somewhere, the receiver will be still, automatically putting the receiver in anti-thievery security mode in which alarming sound is produced at regular intervals. Thus, for example, if the device is buried under documents on the desk, it can be easily found by the owner. Assuming that a conventional wireless selective-call receiver is put in the silent mode, to produce no sound at the time of receiving a telephone call, and the receiver is left somewhere, the owner cannot locate it even if it exists in the vicinity of his position. The receiver according to the present invention is quite free of such inconvenience, thereby permitting him to find his alarming receiver immediately.

The automatic setting of the receiver in the anti-thievery security mode in response to absence of the to-and-fro movement of the receiver's body, which represents the receiver having been put aside from the owner's body, provides the following advantages:

First, on the arrival of a message at the receiver, the messages cannot be exhibited on the display 6, but stored in the memory, thus preventing the exposure of the contents of the message to others.

Second, if the receiver is lost, the contents of messages, collection of telephone numbers, ready-made sentences, guidances, alarm messages, schedules and other pieces of private information cannot be accessed by others.

Third, even if another person finds the receiver, he cannot use it because it is put automatically in inoperative condition. The receiver shows emergency messages such as an emergency contact telephone number and address on its display, and therefore, the finder can notify the owner of the finding. All the while nobody can have access to the pieces of private information stored in the memory of the receiver.

Fourth, assuming that the receiver is stolen after being left, the receiver will be kept inoperative for ordinary use, and therefore, the owner should not be requested to pay for the amount for undesired communications from other subscribers beyond a certain limit of calling times.

What is claimed is:

1. A selective call receiver comprising:

a receiver which receives a call signal and message information;

a display which displays pieces of private information including said message information received by said receiver;

a memory which stores the contents of said private information;

an input which allows for input of commands and data to said selective call receiver;

a controller which controls said display and said memory in response to data from said receiver, said memory, and said input; and a motion detector which detects movement of said selective call receiver, said motion detector further outputs a signal representative of said movement to said controller;

wherein said controller comprises a first control section which performs a standard operation of said selective call receiver, a second control section which performs a security operation of said selective call receiver, and a switch which switches control between said first control section and said second control section in response to said signal from said motion detector.

2. The selective call receiver according to claim 1 wherein said pieces of private information include at least one of messages, a telephone directory, ready-made sentences for daily use, guidances, alarm messages, schedules and memoranda.

3. The selective call receiver according to claim 1 wherein when said call signal corresponds to said selective call receiver, said second control section permits said message information to be stored in said memory, and inhibits said message information from being displayed on said display.

4. The selective call receiver according to claim 1 wherein said second control section inhibits access to said pieces of private information stored in said memory from one of said input and an interface coupled to said selective call receiver.

5. The selective call receiver according to claim 1 wherein said second control section inhibits access to said pieces of private information which were stored in said memory through said receiver.

6. The selective call receiver according to claim 1 wherein said switch is responsive to instructions given through said input at the time of power-on of said selective call receiver for selectively putting said first or second control section in operation.

7. The selective call receiver according to claim 1 wherein when said second control section is selected for operation, and when pieces of information received through said input match a password stored in said memory, said switch switches control from said second control section to said first control section.

8. The selective call receiver according to claim 1 wherein when said second control section is selected for operation, and when a first password received through an interface coupled to said selective call receiver matches a second password stored in said memory, said switch switches control from said second control section to said first control section.

9. The selective call receiver according to claim 1 wherein when said first control section is selected for operation, and when there is no movement of said selective call receiver, said switch switches control from said first control section to said second control section.

10. The selective call receiver according to claim 1 wherein said motion detector comprises:

a contact detecting section which detects said movement of said selective call receiver by different contact conditions; and a contact checking section for making a decision as to whether said selective call receiver moves.

11. The selective call receiver according to claim 10 wherein said contact detecting section comprises:

a spherical cavity having lattice contacts inside, and an electrically conductive spherical body movably contained in said cavity, thereby detecting to and fro movement of said selective call receiver by checking whether said electrically conductive spherical body continues to touch selected contacts one after another.

12. The selective cell receiver according to claim 11 wherein said spherical body maintains the same contacts when no vibration is applied and switches said contacts when vibration is applied.

13. The selective call receiver according to claim 12 wherein said contact checking section makes a decision that said selective call receiver is not moving when said same contacts are maintained for a predetermined period.

14. The selective-call receiver according to claim 11 wherein said contact detecting section has a cubic external shape.

15. The selective call receiver according to claim 1 wherein said switch is able to set a time zone in which said signal output from said motion detector is effective.

16. The selective call receiver according to claim 1 wherein said controller is able to enable and disable said motion detector.

17. The selective call receiver according to claim 1 wherein said selective call receiver further comprises a sound-making section, responsive to instruction given by said controller, for making an alarm sound.

18. The selective call receiver according to claim 17 wherein said second control section issues said instruction.

19. The selective call receiver according to claim 18 wherein said second control section is able to put said sound-making section in an operative or inoperative condition in which said alarm sound is permitted or prevented, respectively.

20. The selective call receiver according to claim 1 wherein said second control section is actuated by said switch, said second control section retrieves emergency telephone numbers from said memory and shows said emergency telephone numbers on said display.

21. The selective call receiver as claimed in claim 1, wherein when said motion detector detects a lack of said movement, said motion detector instructs said controller, through said signal, to inhibit said display from displaying said private information.

22. The selective call receiver as claimed in claim 1 wherein said motion detector detects a to and fro movement.

23. The selective call receiver as claimed in claim 1 further comprising an exterior surface which permits said selective call receiver to be connected to exterior devices.

24. A method of processing a signal received by a pager, said method comprising:

receiving said signal;

detecting movement of said pager and outputting a control signal in response thereto; and switching between a first control mode, indicative of normal operation, and a second control mode, indicative of a security operation, in response to said control signal, wherein said normal operation allows a display of information contained in said signal and said security operation inhibits display of information contained in said signal.

25. The method as claimed in claim 24 wherein said switching comprises switching from said first control mode to said second control mode when said detecting indicates that said pager is not moving.

26. The method as claimed in claim 24 further comprising storing said signal in a memory when said detecting indicates that said pager is not moving.

27. The method a claimed in claim 24 further comprising displaying emergency information when said security operation is activated.

28. The method as claimed in claim 24 wherein said detecting comprises:

providing a cavity having a plurality of contacts and an electrically conductive body disposed therein; and detecting whether said electrically conductive body touches some of said contacts for a predetermined period of time.

* * * * *